US006691592B2

(12) United States Patent
Hahn

(10) Patent No.: US 6,691,592 B2
(45) Date of Patent: Feb. 17, 2004

(54) MECHANICAL BOTTLE OPENER

(76) Inventor: Perry Hahn, 5909 61st Ave., Riverdale, MD (US) 20737

( * ) Notice: Subject to any disclaimer, the term of this patent is extended or adjusted under 35 U.S.C. 154(b) by 0 days.

(21) Appl. No.: 09/917,738

(22) Filed: Jul. 31, 2001

(65) Prior Publication Data

US 2003/0024355 A1 Feb. 6, 2003

(51) Int. Cl.[7] ..... B67B 7/00
(52) U.S. Cl. ..... 81/3.2; 81/3.25; 81/3.43
(58) Field of Search ..... 81/3.2, 3.25, 3.31, 81/3.43, 3.32; D8/36, 40

(56) References Cited

U.S. PATENT DOCUMENTS

| | | | | | |
|---|---|---|---|---|---|
| 3,269,226 | A | * | 8/1966 | Von Tersch | 81/64 |
| 5,056,383 | A | * | 10/1991 | Halpin | 81/3.43 |
| 5,307,712 | A | * | 5/1994 | Pratt | 81/3.43 |
| 5,351,579 | A | * | 10/1994 | Metz et al. | 81/3.2 |
| 6,089,124 | A | * | 7/2000 | Murphy | 81/3.2 |
| 6,148,692 | A | * | 11/2000 | Russell | 81/3.2 |
| 6,431,032 | B1 | * | 8/2002 | Kuryan et al. | 81/64 |

* cited by examiner

*Primary Examiner*—James G. Smith
(74) *Attorney, Agent, or Firm*—H. Jay Spiegel

(57) ABSTRACT

A portable device may be carried by the user, in one preferred embodiment thereof, and motorizes the task of opening beverage containers having a screw cap. The mechanism that couples to the bottle cap consists of a generally circular band having a distal end bent inwardly in the direction of the cap. The bend of the band is sized and configured to permit receipt of the bottle cap with the bent tang of the band engaging the periphery of the bottle cap at one location. The band is mechanically coupled to the drive shaft of a drive motor with the drive shaft extending axially of the band. The drive motor is mounted on a plate carrying a strap designed to receive fingers of the user so that the user may grasp the plate. An activation switch is conveniently located on the plate so that it may be operated by a knuckle or finger of the user. In a second embodiment, the mechanism may be mounted on a bracket mounted, for example, on a bar, with the motor shaft facing downwardly depending from the motor, and with the band located below. In a further modification, the band may be provided with a stepped configuration having regions of differing sizes so that bottles having caps of differing dimensions may all be opened using the subject device.

16 Claims, 6 Drawing Sheets

MECHANICAL BOTTLE OPENER

BACKGROUND OF THE INVENTION

The present invention relates to a mechanical bottle opener. In the prior art, it is known to open bottles having threaded caps using various manually operated means. Of course, such bottle caps may be opened by hand by grasping the bottle cap in one hand, the bottle in the other hand, and twisting one hand with respect to the other in the proper direction to rotate the cap and remove it from the bottle. Often, after a short period of time opening several such bottles, abrasions are formed on the fingers and hand of the user making it difficult or painful to continue opening bottles. This affliction is common among those who sell bottled beverages at stadiums and arenas. Also, sore wrists often result from opening of multiple beverage bottles and repetitive motion injuries are also possible. As such, a need has developed for a mechanism which may be used to open a multiplicity of bottles having threaded caps without damaging the hands and wrists of the person opening them.

The following prior art is known to Applicant:

U.S. Pat. No. 5,056,383 to Halpin discloses a bottle opener in which a flexible ring includes an open end having an inwardly bent end and a plurality of projections about its inner circumference. A handle extends laterally of the band so that the band may be placed over a bottle cap and rotated to open the bottle. The present invention differs from the teachings of Halpin as contemplating a band in which the connection thereto is made axially of the band and that connection is motorized. Furthermore, Applicant's band is greatly simplified over the band of Halpin as not requiring the projections of the Halpin band and as not requiring teeth at the far edge of the bent portion.

U.S. Pat. No. 5,207,125 to Pierce, Jr. et al. discloses an opener for screwed cap containers in which a flexible strap is operated through a complicated mechanical mechanism to tighten about the screw cap of a bottle and open it. The present invention differs from the teachings of Pierce, Jr. et al. as contemplating a simple mechanism in which a flexible band has a bent tang at the end thereof which engages one location about the periphery of a bottle cap so that when the associated motor is operated, the bottle cap may be rotated to open the bottle.

U.S. Pat. No. 5,458,027 to Rambin discloses an oil filter wrench in which a flexible strap or belt has a plurality of concentric turns with the central opening thereof receiving an oil filter. A hand loop is formed in the strap which may be grabbed and pulled to remove slack from the turns of the strap, tightly engage the oil filter and remove it. The present invention differs from the teachings of the present invention as contemplating a device which is motor operated and wherein the connection between the motor and the flexible strap is axial of the strap rather than lateral of the strap.

U.S. Pat. No. 5,704,258 to LaVoie discloses a bottle opening device in which a strap has an open end which is locked in the plane of the strap to tighten the strap about a cap which is to be removed. The present invention differs from the teachings of LaVoie as contemplating a bottle opener in which a motor is connected axially of the strap.

SUMMARY OF THE INVENTION

The present invention relates to a mechanical bottle opener. The present invention includes the following interrelated objects, aspects and features:

(1) In a first aspect, the present invention contemplates a portable device that may be carried by the user, in one preferred embodiment thereof, and which may motorize the task of opening beverage containers having a screw cap.

(2) In the preferred embodiment of the present invention, the mechanism that couples to the bottle cap consists of a generally circular band preferably made of spring steel and having a distal end bent inwardly in the direction of the cap. The bend of the band is sized and configured to permit receipt of the bottle cap therewithin with the bent tang of the band engaging the periphery of the bottle cap at one location thereon.

(3) The band is mechanically coupled to the drive shaft of a drive motor with the drive shaft extending axially of the band in a direction away therefrom.

(4) In the preferred embodiment, the drive motor is mounted on a plate also having a strap designed to receive fingers of the user thereon so that the user may grasp the plate with the motor attached thereto. An activation switch is conveniently located on the plate so that it may be operated by a knuckle or finger of the user.

(5) In operation, the user mounts the plate on their fingers and a battery power supply is coupled to the motor by any suitable means. A bottle with a cap affixed thereto is grasped with the other hand with the cap inserted into the opening within the band with the tang of the band engaging the periphery of the cap. The switch is closed activating the motor to rotate the band and, with the tang engaging the periphery of the cap, the cap is rotated and removed from the bottle.

(6) In a second embodiment of the present invention, the mechanism may be mounted on a bracket mounted, for example, on a bar, with the motor shaft facing downwardly depending from the motor, and with the band located therebelow.

(7) In this second embodiment, the motor is mounted on the bracket in such a way that the motor may slightly reciprocate up and down. This up and down movement allows a proximal end of the motor to engage an on-off switch to activate and deactivate the motor. When a bottle is placed under the band and then pushed upwardly into the band, when the cap engages the mounting device attached to the motor shaft, and the bottle is pushed further upwardly, the motor itself reciprocates upwardly, thereby closing the switch and causing the shaft to rotate thereby opening the bottle using the same mechanism as explained above with respect to the first embodiment.

(8) In a further modification, the band may be provided with a stepped configuration having regions of differing sizes so that bottles having caps of differing dimensions may all be opened using the subject device.

As such, it is a first object of the present invention to provide a mechanical bottle opener.

It is a further object of the present invention to provide such a device wherein the bottle opener consists of a motor operated device with the motor mounted on a plate which may be attached to the hand of a user.

It is a still further object of the present invention to provide such a device wherein the mechanism itself consists of a flexible band having a bent tang at its end.

It is a still further object of the present invention to provide such a device wherein the motor is mounted on a bracket mounted on a flat surface such as, for example, a bar.

It is a still further object of the present invention to provide such a device wherein the band itself has a stepped configuration permitting opening of bottles having caps of differing sizes and configurations.

These and other objects, aspects and features of the present invention will be better understood from the following detailed description of the preferred embodiments when read in conjunction with the appended drawing figures.

SPECIFIC DESCRIPTION OF THE PREFERRED EMBODIMENTS

Figure 1:
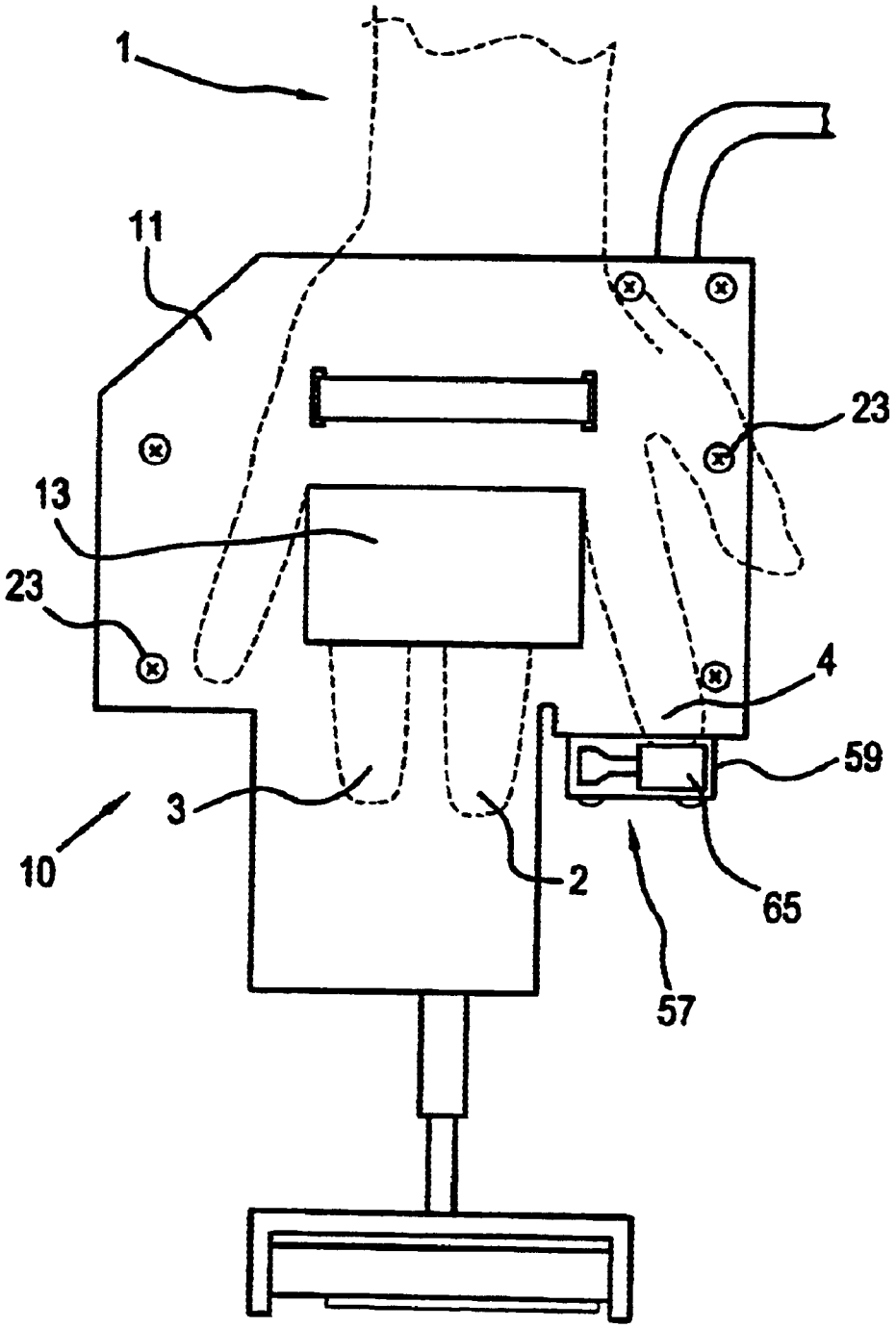
FIG. 1 shows a top view of a first embodiment of the present invention.
Figure 2:
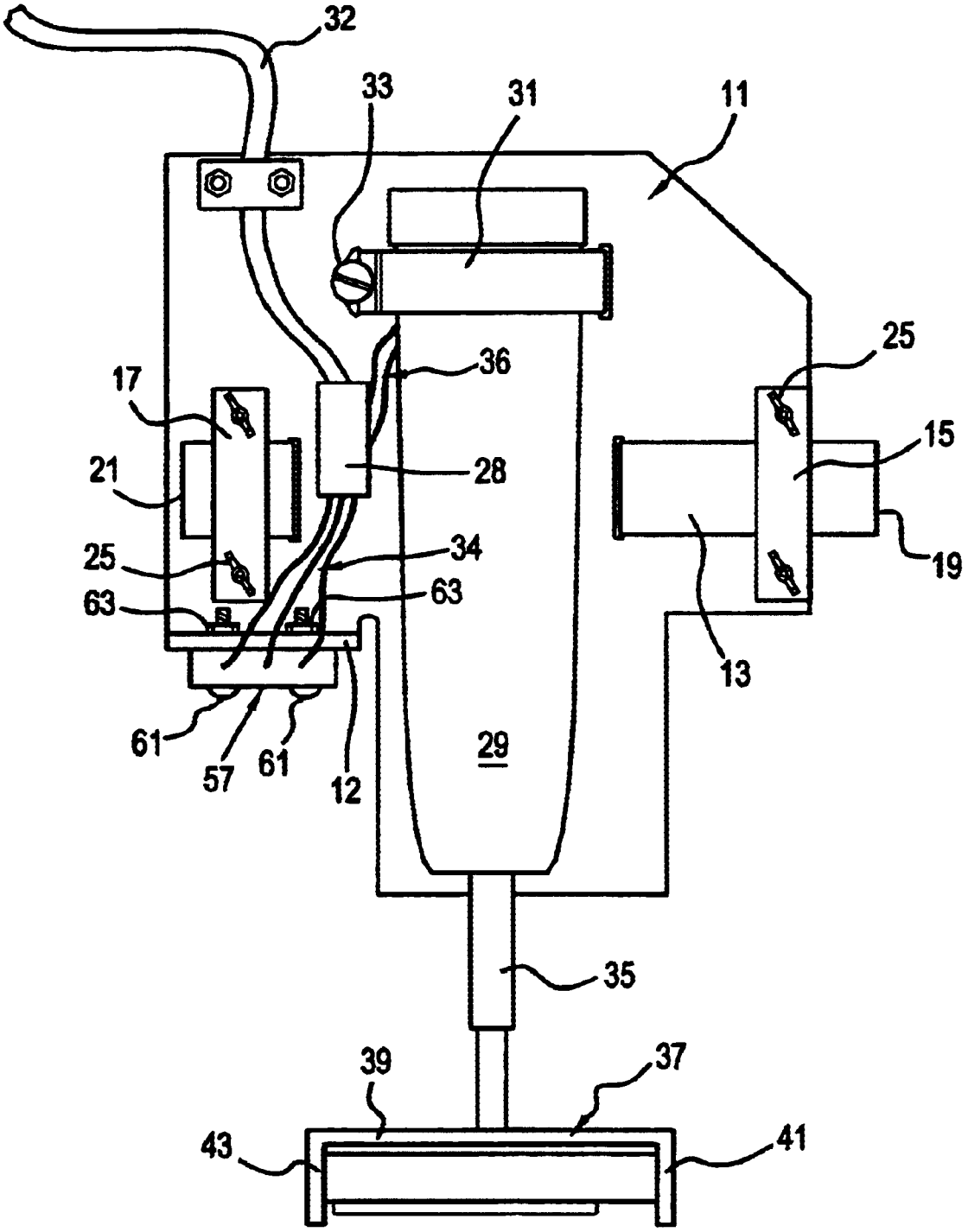
FIG. 2 shows a bottom view of the invention illustrated in FIG. 1.
Figure 3:
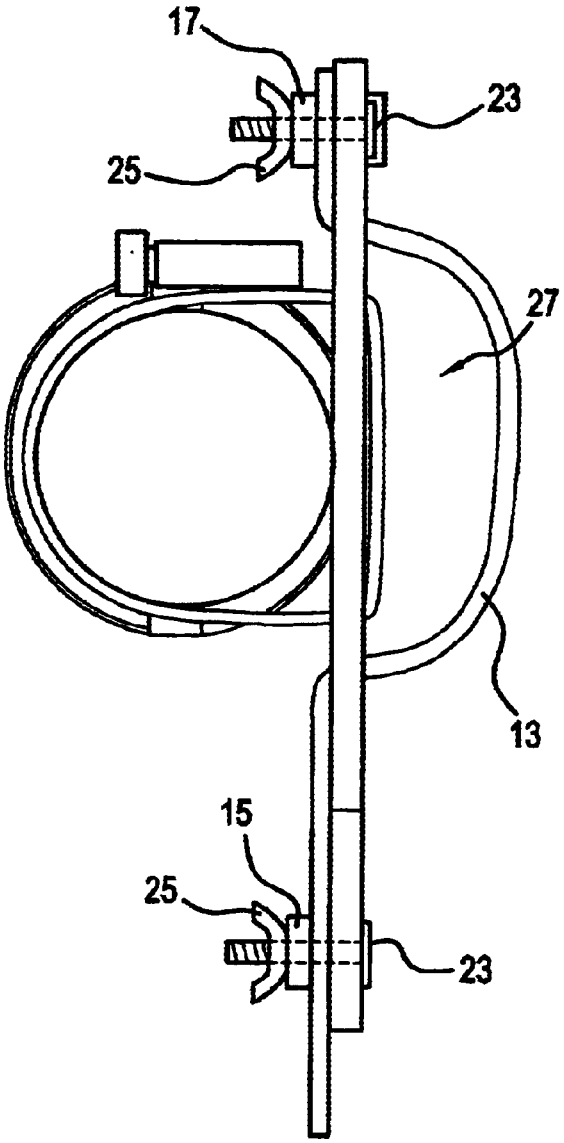
FIG. 3 shows a view looking from the rear of the first embodiment of the present invention.

With reference, first, to FIG. 1, a first embodiment of the present invention is generally designated by the reference numeral 10 and includes a generally flat plate 11 having a strap 13 clamped thereon and sized and configured to allow at least two fingers of a human hand to be placed thereunder. The clamping mechanism for the strap 13 is best seen with reference to FIG. 2 consisting of the plates 15 and 17 which clamp respective ends 19 and 21 of the strap 13 through the use of screws 23 (FIG. 1) and wing nuts 25 (FIG. 2). The strap 13 is best seen with reference to FIG. 3 to define an area 27 sized to receive the fingers of the user.

With reference to FIG. 2, a motor 29 is mounted on the plate 11 using a clamp 31. In the example shown, the clamp 31 consists of a hose clamp such as is used to clamp radiator hoses on a vehicle. The clamp 31 is shown in FIG. 2 to include a screw mechanism 33 well known to those skilled in the art which may be rotated in one direction to tighten the clamp 31, and which may be rotated in the opposite direction to loosen the clamp.

FIG. 2 shows a box 28 which schematically shows the interconnection of different electrical conductors including the electrical conductor 32 connected to a source of power such as a battery (not shown), electrical conductors 34 emanating from the switch 57 and electrical conductors 36 emanating from the motor 29.

Figure 4:
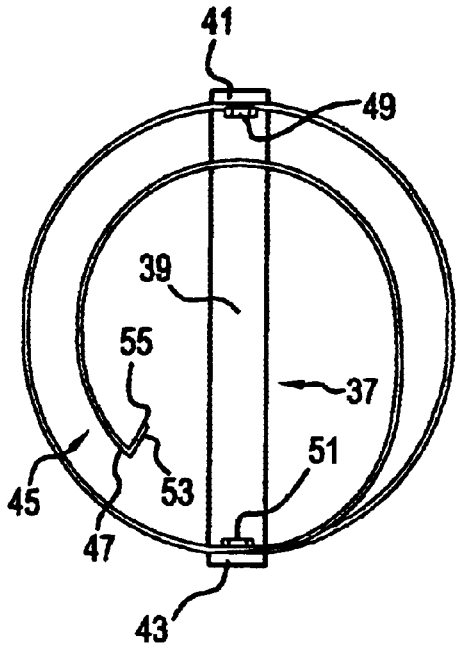
FIG. 4 shows a front view of the flexible band and mount therefor of the present invention.

As further seen in FIGS. 1 and 2, the motor 29 includes a drive shaft 35 which is coupled to a fitting 37 consisting of an elongated bar 39 with two depending ends 41 and 43. These aspects are better seen with reference to FIG. 4. With further reference to FIG. 4, it is seen that a flexible band 45 is mounted on the fitting 37 and includes a free end 47 having a bent tang 49 with its distal edge 51 extending inwardly. Portions of the band 45 are clamped to the two depending ends 41 and 43 using suitable screws 49 and 51 best seen in FIG. 4 or rivets, if desired. The band 45 is made of any suitable flexible material such as spring steel or plastic. In the preferred embodiment, the material of the band 45 has a similar thickness and resiliency as a radiator hose clamp such as is depicted using the reference numeral 31.

With reference back to FIGS. 1 and 2 in particular, an on-off switch is generally designated by the reference numeral 57 and is seen to include a housing 59 mounted on a bent portion 12 (FIG. 2) of the plate 11 using threaded fasteners 61 and threaded nuts 63. The switch 57 includes an actuator 65 which is pivotably mounted on the housing 59 in a manner well known to those skilled in the art and is spring biased in the open position of the switch 57.

With particular reference to FIG. 1, a schematic depiction of a human hand 1 is seen with the middle finger 2 and ring finger 3 shown enclosed by the band 13 and with the forefinger 4 shown in a location where it may engage the switch operator 65. Thus, it should be understood that with the hand 1 attached to the plate 11 in the manner shown in FIG. 1, the user may use the tip or knuckle of the forefinger 4 to close the switch 57 to activate the motor 29.

Figure 5:
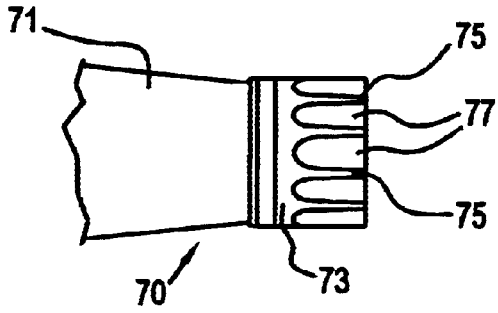
FIG. 5 shows a typical bottle having a rotary cap.

With reference to FIG. 5, a bottle 70 is seen to include a body 71 with an upper opening (not shown) closed by a threaded cap 73. The cap includes a plurality of peripheral projections 75 defining therebetween a plurality of recesses 77. The tang 53 of the band 45 (FIG. 6) is specifically designed to engage the periphery of the cap 73 with the edge 55 thereof entering one of the recesses 77 and engaging a side wall of one of the peripheral projections 75. In the configuration shown in FIG. 6, when the motor 29 is activated, the cap 73 will be rotated by the rotation force of the motor imposed on the band 45 to remove the cap 73 from the bottle 71.

Figure 7:
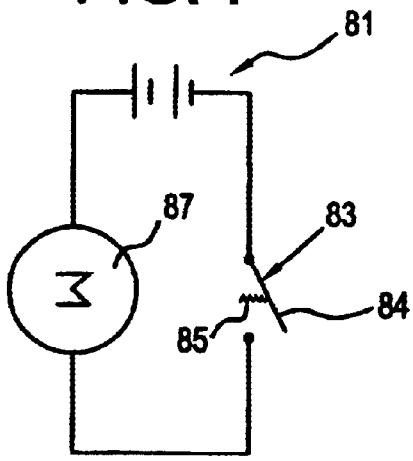
FIG. 7 shows a schematic representation of the electrical circuitry of the present invention.

As seen in FIG. 7, the electrical circuitry of the present invention is quite simple. The circuitry includes a power source 81, preferably consisting of a battery, an on-off switch 83, schematically shown as including a spring 85 biasing the activator 84 to the open position and a motor 87 operated by the battery 81 when the switch 83 is closed.

Figure 6:
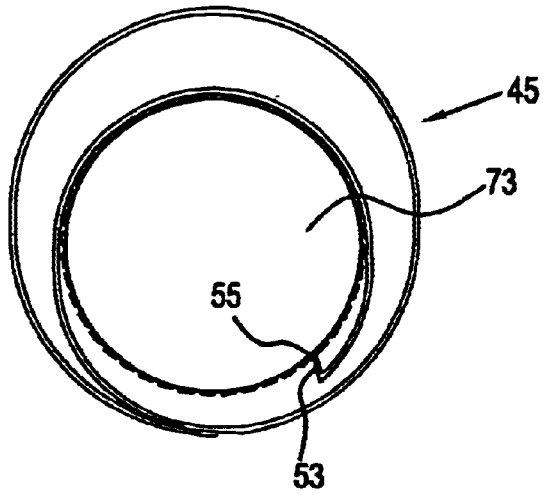
FIG. 6 shows the interaction between the flexible band and a bottle cap.

As should be understood by those skilled in the art, based upon the above description, in order to open a bottle such as the bottle 70 depicted in FIG. 5, the cap 73 thereof is inserted within the band 45 as shown in FIG. 6. The switch 57 is closed by movement of the finger 4 to cause the motor 29 shaft 35 to rotate so that the edge 55 of the tang 53 of the band 45 engages one of the recesses 77 of the cap 73 causing, so that with the user's other hand tightly gripping the bottle 71, the cap 73 is rotated and removed therefrom.

Figure 8:
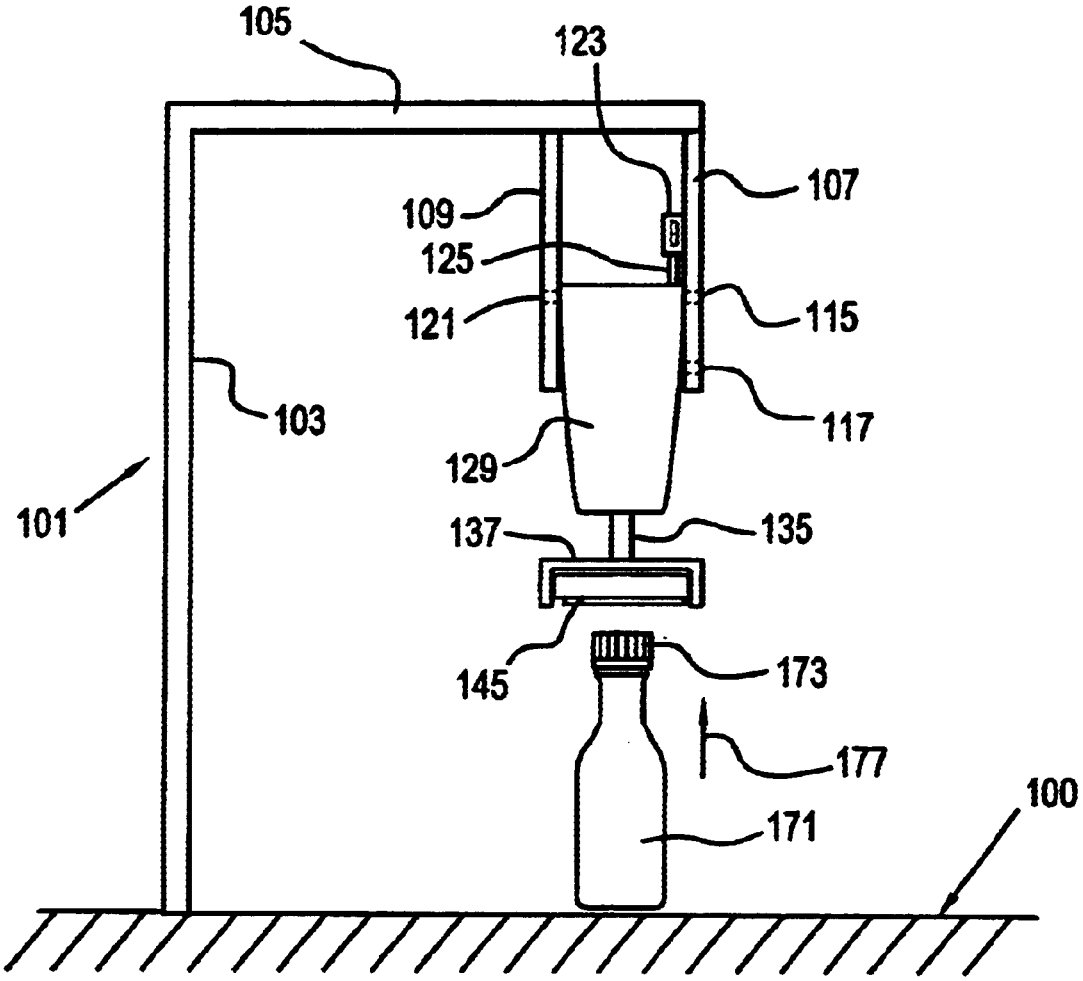
FIG. 8 shows a side view of a second embodiment of the present invention.
Figure 9:
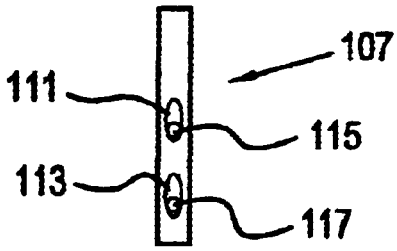
FIG. 9 shows a detail of one of the aspects of the invention as illustrated in FIG. 8.

FIGS. 8 and 9 depict an alternative embodiment of the present invention. A flat surface is generally designated by the reference numeral 100 and may consist of a table or a bar top or any other flat surface. A bracket 101 is affixed to the surface 100 in any suitable manner and includes an upwardly extending portion 103, a horizontally extending portion 105 and two depending brackets 107 and 109. As seen in FIG. 9, the bracket 107 includes two elongated slots 111 and 113 which receive posts 115 and 117, respectively, each of which is affixed to the side of the motor 129. A further post 121 is affixed to the other side of the motor 129 and is inserted in a slot (not shown) corresponding to either of the slots 111 or 113 but located in the bracket 109. A switch mechanism 123 is mounted on the bracket 107 and includes a reciprocating switch actuator 125 spring biased in the downward direction of FIG. 8 which corresponds to the open position of the switch 123.

The motor 129 includes a shaft 135 to which is affixed a fitting 137 corresponding to the fitting 37 shown in the embodiment of FIGS. 1–7, and with the fitting 137 carrying a flexible band 145 corresponding in size and configuration to the band 45 best seen with reference to FIGS. 4 and 6.

A bottle 171 is shown including a cap 173 corresponding to the bottle 71 and cap 73 best seen with reference to FIG. 5.

In the operation of the embodiment of FIGS. 8 and 9, the bottle 171 is moved under the band 145 and then moved upwardly in the direction of the arrow 177 until the bottle 171 is in the position corresponding to that which is illustrated with reference to FIG. 6. Further upward movement causes the entire motor 129 to move upwardly in the slots 115 and 117 (and the corresponding slot within the bracket 109) until the switch actuator 125 is moved upwardly closing the switch 123 and thereby activating the motor 129 to remove the cap 173 from the bottle 171. Thereafter, the bottle 171 is moved downwardly and away from the device 101.

Figure 10:
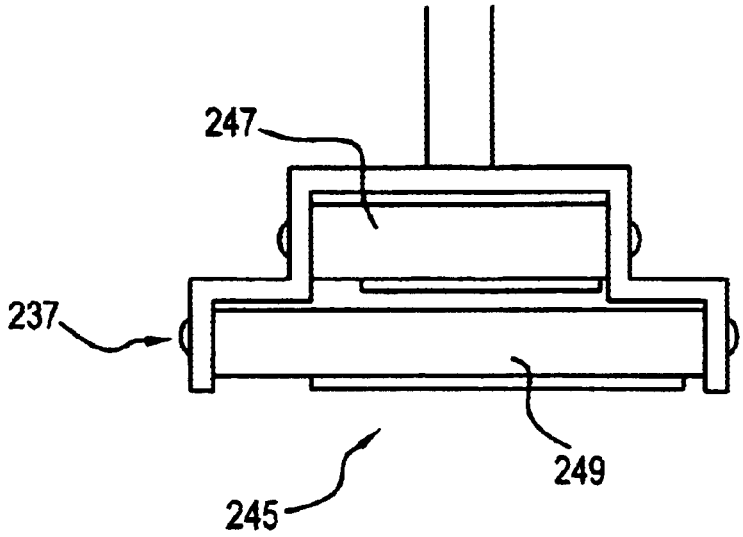
FIG. 10 shows a side cross-sectional view of an alternative construction of the flexible band of the present invention.
Figure 11:
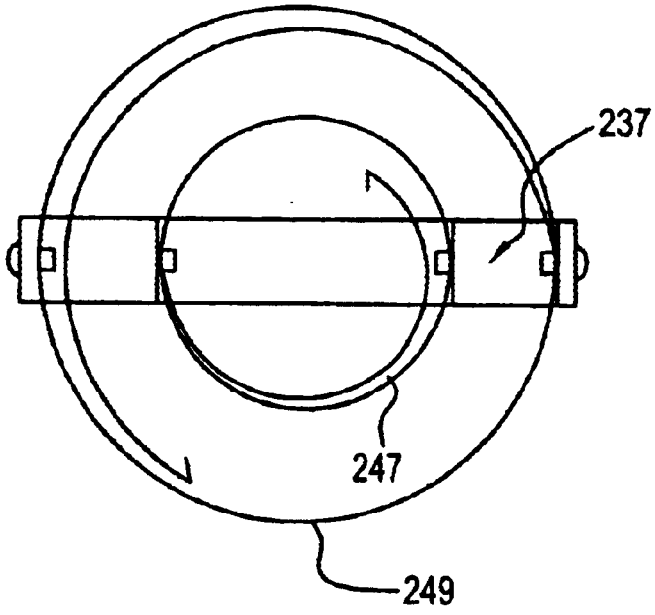
FIG. 11 shows an end view of the device of FIG. 10.

With reference to FIGS. 10–11, the band 145 may be modified with a stepped configuration. FIG. 10 schematically shows the fitting 237 which corresponds to the fittings 37 and 137 depicted in the embodiments of FIGS. 1–9 except that it now has a stepped configuration. The band 245 now includes a narrower diameter band portion 247 and a wider diameter band portion 249. The portions of the band 245 are sized so that bottle caps of differing dimensions can be opening using the present invention. Thus, some larger sized bottle caps will fit within the band portion 249 whereas other smaller bottle caps may be moved past the band portion 249 and into the band portion 247 to be engaged thereby in the manner described hereinabove. As shown, the band portions 247 and 249 preferably comprise separate bands affixed to the stepped interior configuration of the device 237 using suitable means such as, for example, rivets or threaded fasteners.

As such, an invention has been disclosed in terms of preferred embodiments thereof which fulfill each and every one of the objects of the invention as set forth hereinabove, and provide embodiments of a new and useful mechanical bottle opener of great novelty and utility.

Of course, various modifications, alterations and changes in the teachings of the present invention may be contemplated by those skilled in the art without departing from the intended spirit and scope thereof.

As such, it is intended that the present invention only be limited by the terms of the appended claims.

What is claimed is:

1. A mechanical bottle opener, comprising:

a) a motor having a rotary shaft coupled thereto;

b) said motor being connected to a source of electric power, said motor being mounted on a plate, said plate carrying a strap adapted to receive fingers of a user's hand;

c) a band coupled to said shaft, said band including a curved portion at least partially surrounding an axis of elongation of said shaft, said band refraining from spiraling in a direction along said axis, and said band including an inwardly directed bent tang having a terminating edge, said band having a smooth inner surface;

d) an opening within said band sized to receive therein a bottle cap;

e) whereby, with a bottle cap within said opening, said motor may be activated to rotate said shaft and band, whereupon said terminating edge of said tang engages a periphery of said cap and rotates said cap with respect to a bottle to which said cap is affixed.

2. The opener of claim 1, further including an on-off switch mounted on said plate and electrically coupled to said motor.

3. The opener of claim 2, wherein said switch has an actuator biased to an open position of said switch.

4. The opener of claim 1, wherein said band is made of spring steel.

5. The opener of claim 1, wherein said band is coupled to said shaft via a fitting, said fitting including:

a) a first portion coupled to said shaft and extending perpendicularly with respect thereto;

b) two legs at opposite ends of said first portion, said legs extending generally perpendicularly to said first portion;

c) said band mounted between said legs.

6. A mechanical bottle opener, comprising:

a) a motor having a rotary shaft coupled thereto, said motor being mounted on a plate, said plate carrying a strap adapted to receive at least one finger of a user's hand;

b) said motor being connected to a source of electric power comprising a battery and further including an on-off switch mounted on said plate and electrically coupled to said motor and battery;

c) a steel band coupled to said shaft, said band including a curved portion at least partially surrounding an axis of elongation of said shaft, and an inwardly directed bent tang having a terminating edge;

d) an opening within said band sized to receive therein a bottle cap;

e) whereby, with a bottle cap within said opening, said motor may be activated to rotate said shaft and band, whereupon said terminating edge of said tang engages a periphery of said cap and rotates said cap with respect to a bottle to which said cap is affixed.

7. The opener of claim 6, wherein said switch has an actuator biased to an open position of said switch.

8. The opener of claim 6, wherein said band is coupled to said shaft via a fitting, said fitting including:

a) a first portion coupled to said shaft and extending perpendicularly with respect thereto;

b) two legs at opposite ends of said first portion, said legs extending generally perpendicularly to said first portion;

c) said band mounted between said legs.

9. The opener of claim 6, wherein said strap is sized to receive two fingers of a user's hand.

10. The opener of claim 9, wherein said plate is generally flat.

11. The opener of claim 6, wherein said band comprises a first band having a first diameter, and further comprising a second band having a second diameter different from said first diameter, said first and second bands mounted on said shaft with a smaller diameter one of said bands closer to said motor.

12. A mechanical bottle opener, comprising:

a) a motor having a rotary shaft coupled thereto;

b) said motor being connected to a source of electric power and being reciprocably slidable on a bracket, an on-off switch being mounted between said motor and bracket whereby movements of said motor with respect to said bracket activate said switch, said switch being mounted on said bracket and including an actuator biased to an open position of said switch, said actuator being moved by said motor when said motor moves with respect to said bracket;

c) a band coupled to said shaft, said band including a curved portion at least partially surrounding an axis of elongation of said shaft, said band refraining from spiraling in a direction along said axis, and said band including an inwardly directed bent tang having a terminating edge, said band having a smooth inner surface;

d) an opening within said band sized to receive therein a bottle cap;

e) whereby, with a bottle cap within said opening, said motor may be activated to rotate said shaft and band, whereupon said terminating edge of said tang engages a periphery of said cap and rotates said cap with respect to a bottle to which said cap is affixed.

13. The opener of claim 12, wherein said bracket is mounted on a fixed surface.

14. The opener of claim 12, wherein said fixed surface comprises a bar top.

15. The opener of claim 12, wherein said motor is mounted on said bracket with said shaft extending downwardly.

16. A mechanical bottle opener, comprising:

a) a motor having a rotary shaft coupled thereto;

b) said motor being connected to a source of electric power;

c) a band coupled to said shaft, said band including a curved portion at least partially surrounding an axis of elongation of said shaft, said band refraining from spiraling in a direction along said axis, and said band including an inwardly directed bent tang having a terminating edge, said band having a smooth inner surface, said band comprising a first band having a first diameter, and further comprising a second band having a second diameter different from said first diameter, said first and second bands mounted on said shaft with a smaller diameter one of said bands closer to said motor;

d) an opening within said band sized to receive therein a bottle cap;

e) whereby, with a bottle cap within said opening, said motor may be activated to rotate said shaft and band, whereupon said terminating edge of said tang engages a periphery of said cap and rotates said cap with respect to a bottle to which said cap is affixed.

* * * * *